US005190174A

United States Patent [19]

Klag

[11] Patent Number: 5,190,174

[45] Date of Patent: Mar. 2, 1993

[54] SWIVEL TEAT FOR BABY BOTTLE

[76] Inventor: Robert W. Klag, 7 Azalea Dr., Mill Valley, Calif. 94941

[21] Appl. No.: 707,381

[22] Filed: Jan. 31, 1991

Related U.S. Application Data

[63] Continuation of Ser. No. 144,746, Jan. 19, 1988, abandoned, which is a continuation-in-part of Ser. No. 11,191, Feb. 5, 1987, abandoned.

[51] Int. Cl.[5] ..... A61J 11/04

[52] U.S. Cl. ..... 215/11.1

[58] Field of Search ..... 215/11.1, 11.4, 11.5, 215/11.6; 119/71

[56] References Cited

U.S. PATENT DOCUMENTS

| | | | |
|---|---|---|---|
| 401,505 | 4/1889 | Lockwood | 215/11.1 |
| 2,094,268 | 9/1937 | Friedman | 138/78 |
| 2,588,069 | 3/1952 | Allen | 215/11.1 |
| 2,709,434 | 5/1955 | Pancoast | 215/11 R X |
| 2,812,764 | 11/1957 | Crisp | 215/11 R |
| 3,113,569 | 12/1963 | Barr et al. | 215/11.1 |
| 3,394,018 | 7/1968 | Veconis et al. | 215/11 R X |
| 4,505,398 | 3/1985 | Kesselring | 215/11 R X |
| 4,813,556 | 3/1989 | Lawrence | 215/11.1 X |

FOREIGN PATENT DOCUMENTS

| | | | |
|---|---|---|---|
| 1260680 | 4/1961 | France | 215/11 R |

*Primary Examiner*—Robert P. Swiatek

[57] ABSTRACT

An infant feeding apparatus comprising a feeding bottle 10 having a nipple or teat 12 which has a corrugated swivel portion 30 to enable the teat to bend freely between bottle's neck and the end of the teat 12 without restricting beverage 18 flow through teat 12.

16 Claims, 1 Drawing Sheet

SWIVEL TEAT FOR BABY BOTTLE

This application is a continuation of 07/144,746, filed Jan. 19, 1988, now abandoned, which is a continuation of 07/011,191, filed Feb. 5, 1987, and now abandoned.

BACKGROUND

1. Field of Invention

This invention relates to an infant feeding apparatus, specifically to an improved feeding teat or nipple for a baby bottle.

2. Description of Prior Art

Nursing bottles which deliver beverages to infants through an artificial teat or nipple have been used extensively as an alternative to breast feeding; thus, most improvements in such teats and their bottles have concentrated on simulating breast feeding. When an infant is being nursed by its mother, the most desirable position for the infant is with its torso in an upwardly inclined position; therefore, when an infant is being fed from a bottle the infant should also be in the natural feeding position: torso inclined slightly upward with neck straight, the teat perpendicular to and in alignment with the centerline of the mouth of the infant. However, the teat of conventional feeding bottles is coaxial with the feeding bottle so that as the infant nurses the feeding bottle must be tilted upwardly (more vertical) to keep the teat below the beverage level to enable the infant to feed without intaking air. As the incline of the feeding bottle is raised, the infant must respond by tilting its head back to an uncomfortable and unnatural nursing position. Heretofore, teats designed to enhance flexibility have concentrated on axial displacement for the pumping of beverage into the nursing infant's mouth. However, to effect such axial movements, the teat must remain coaxial with the feeding bottle so that one would have the same difficulty as with conventional teats to maintain proper positioning to the nursing infant.

OBJECTS AND ADVANTAGES

Accordingly it is an object of the present invention to provide a feeding teat which will allow an infant to be bottle fed with its torso slightly upwardly inclined with its neck straight while allowing substantially complete discharge of all beverage therein, before it is possible for the feeding infant to draw air through the teat nipple. Another object is to provide a bottle with a teat which conforms to conventional retaining cap nuts, so as to provide a teat which will be economically retrofitted to existing feeding bottles, which is long lasting and which is relatively trouble free in operation.

Further objects and advantages of my invention will become apparent from a consideration of the drawings and ensuing description.

DRAWING FIGURES

DRAWING REFERENCE NUMERALS

Figure 1:
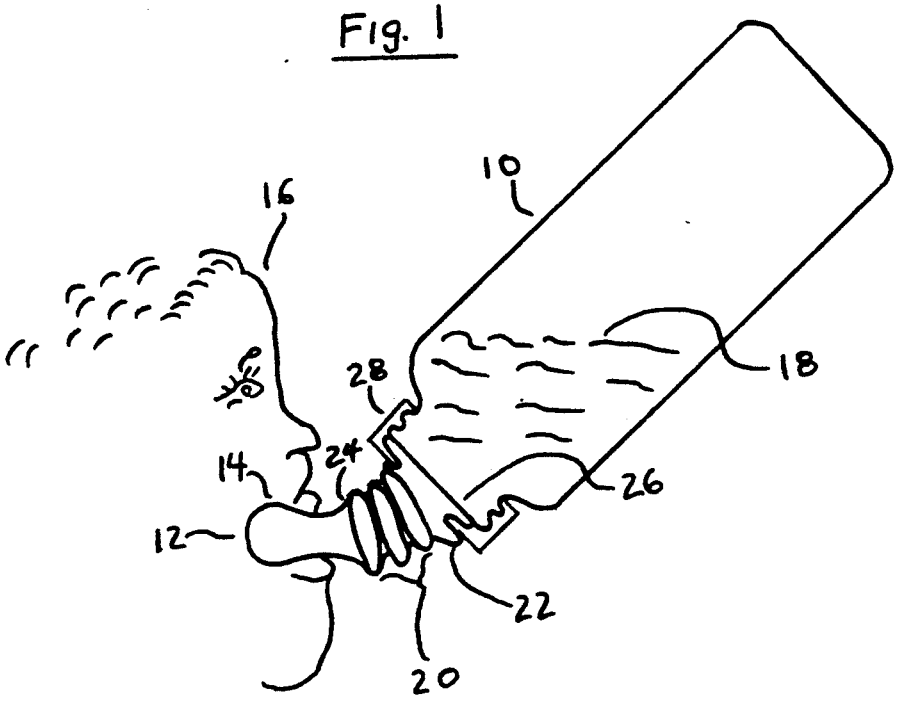
FIG. 1 is a diagrammatic view of the teat of my invention, used in conjunction with a feeding bottle, illustrated in the manner used by a feeding infant.

10: bottle
12: teat
14: infant's mouth
16: feeding infant
18: beverage
20: flexible portion
22: teat body portion
24: tapered portion
26: flange
28: annular cap nut
30: corrugations
32: thicker wall portion

SWIVEL APPARATUS

OPERATION

The broad aspects of my invention may be more fully understood by direct reference to the drawings.

In FIG. 1, a feeding bottle 10 has a rubber or plastic teat 12 which is inserted into the infant's mouth 14 of feeding infant 16. Bottle 10 is tilted perpendicular to infant's mouth 14 so that milk or other beverage 18 will flow without air through teat 12. Teat 12 comprises a flexible portion 20 located between the teat body portion 22 and the tapered portion 24; thus, enabling it to be bent as shown, so that, although tapered portion 24 is perpendicular to infant's mouth 14, bottle 10 can be tilted upwardly. The teat body portion 22 is held to bottle 10 by means of an integral flange 26 which is in turn held to the rim of bottle 10 by an annular cap nut 28.

Physical Description

Figure 2:
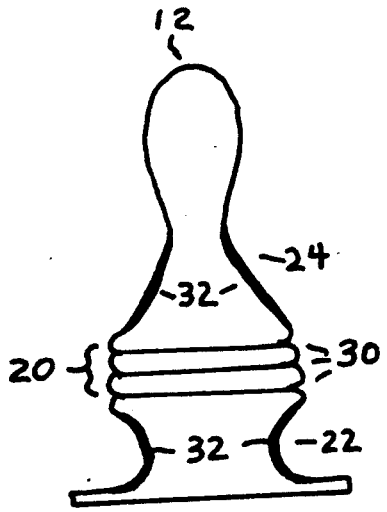
FIG. 2 is a longitudinal section through a corrugated portion of the teat.

Flexible portion 20 of teat 12 is shown in more detail in FIG. 2, and is formed by a series of corrugations 30 extending around the teat 12. These corrugations 30 need not be excessively deep to provide sufficient flexibility. This enables the teat to bend enough so that the proper nursing angle may be attained when the volume of beverage 18 is substantially depleted, but without inverting teat 12 or substantially reducing the lumen thereof and obstructing the flow of beverage 18 to teat 12. I have also found that flexibility is enhanced by forming relatively rigid ends above and below corrugations 30 by means of thicker wall portions 32 at teat body portions 22 and the tapered portions 24. The tapered portion 24 forms a downward and inward recess to transition the radial movement of the bottle directly to the zone of corrugations 30.

The teat which has been described can be made from any desired elastomer, particularly from rubber or rubber substitutes or other materials having comparable properties.

CONCLUSIONS, RAMIFICATIONS AND SCOPE

Thus the reader will see that the nursing bottle teat of my invention provides a reliable and economical nursing and feeding device for the bottle fed infant, yet is easily retrofitted to the most commercially successful feeding bottles and alternative teat nipples, e.g., for orthodontics, weaning, etc.

While my above description contains many specificities, these should not be construed as limitations on the scope of the invention, but rather as an exemplification of one preferred embodiment thereof. It will be obvious to those skilled in the art that many other variations are possible. For example, the swivel portion depicted contains three corrugations, but any other number could be used. It is also obvious that it is not necessary for the cross section of the teat to be cylindrical, and my invention may be applied to all teats regardless of their cross sectional shape, even though the flexibility may be obtained only in one plane. In addition, the mouthpiece can be altered for use by adults, for example, in hospitals where it is customary to feed reclining patients or for commuter cups where eye contact with the road requires a stationary head while drinking. Nor should my invention be limited by the materials suggested or be limited in placement to the feeding teat, since it can be constructed from alternative materials such as plastics and placed in such alternative positions as the cap nut or bottleneck, and be effective. Accordingly, the scope of the invention should be determined not by the embodiment illustrated, but by the appended claims and their legal equivalents.

I claim:

1. In combination:

a beverage container having an artificial teat through which liquid can be discharged from said container into an orifice of a drinker, said teat having a body having an interior and exterior profile and first and second opposite ends, said teat comprising at least one expandable corrugation extending from said interior to said exterior profile of said teat and intermediate said ends thereof, said at least one corrugation allowing said teat to bend freely without inhibiting a flow of liquid therethrough and without limiting the depth of insertion into said drinker's orifice, said body of said teat containing, when said teat is positioned with one end upward and said second end downward, a downwardly and inwardly tapered portion below said at least one corrugation, said portion being sufficiently rigid to define where said teat may bend during use without blocking the flow of beverage therethrough and without tilting said teat in conjunction with said beverage container when drinking.

2. The container of claim 1 wherein said at least one corrugation is expandable and compressible, the expandability of said at least one corrugation being proportional to its compressibility.

3. The container of claim 1 wherein said second end of said teat has a flange so as to permit said teat to be clamped to a rim of said container.

4. The container of claim 1 wherein said teat has a thicker wall portions surrounding said at least one corrugation so as to permit bending to occur substantially at said at least one corrugation.

5. In combination:

a beverage container and an artificial teat therefor, said teat having walls of material sufficiently rigid to allow a beverage to flow therethrough during an infant's nursing, means facilitating the use of said teat to feed an animal, without tilting said teat in conjunction with said beverage container when drinking the beverage in said container, said means allowing said teat to bend freely without substantially decreasing the lumen thereof, said means having a body having an interior and exterior profile and first and second opposite ends, said means comprising a zone of at least one expandable transverse corrugation formed in said wall material extending from said interior to said exterior profile of said teat and intermediate the ends of said teat, said at least one corrugation allowing said teat to bend freely without limiting the depth of insertion into said mouth of said infant nursing, the body of said teat containing a downwardly and inwardly tapered portion below said at least one corrugation sufficient to define where said teat may bend during use without blocking the flow of beverage therethrough.

6. The container of claim 5 wherein said at least one corrugation is expandable and compressible, the expandability of said at least one corrugation being proportional to its compressibility.

7. The container of claim 5 wherein said teat comprises a relatively rigid end having a drinking orifice thereat, said at least one corrugation being spaced sufficiently from said rigid end to permit said bend to occur substantially at a rim of said beverage container.

8. The container of claim 5 wherein said second end of said teat has a flange so as to permit said teat to be clamped to a rim of said container.

9. The container of claim 5 wherein said teat has a thicker wall portion surrounding said at least one corrugation so as to permit said bend to occur substantially at said at least one corrugation.

10. A method of feeding a liquid to an infant or other animal without said animal having to drink from an open-mouthed container, and while allowing said animal to drink with the head of said animal inclined in a comfortable position throughout drinking, comprising the following steps:

providing an elongated beverage container having walls which are concentric to an axis of elongation of said container, said container having an open mouth closed by an artificial teat through which said liquid in said container can be dispensed to the mouth of said animal in response to suction on said teat from said mouth of said animal, said teat comprising an elongated member having two opposite ends, one end having means for attaching said teat to said open mouth of said container, an other end having a discharge outlet, said teat having a body having an interior and exterior profile and first and second opposite ends, said teat having a cylindrical wall portion concentric to an axis of elongation of said teat, said axis of elongation of said teat being coaxial with said axis of elongation of said container, said wall portion having at least one expandable and compressible corrugation intermediate said ends thereof, said at least one corrugation extending from said interior to said exterior profile of said teat and being sufficiently flexible to enable a base part of said teat between said at least one corrugation and said one end thereof to be freely bent away from a front part of said teat between said at least one corrugation and said other end thereof while still allowing said liquid in said container to flow freely from said container through said teat, said at least one corrugation being capable of being inserted into said open mouth of said animal without restriction, orienting said head of said animal so that it is inclined at a comfortable position between the horizontal and the vertical, placing said teat into said mouth of said animal with the axes of elongation of said teat and said container also inclined at an angle between the horizontal and the vertical and being generally perpendicular to said head of said animal, allowing said animal to suck said liquid from said container through said teat, and as said liquid in said container is depleted, bending said base part of said teat and said container such that (a) the axes of elongation of said base part of said teat and said container are oriented to a more vertical position than the axis of elongation of said front part of said teat, (b) said teat bends at said at least one corrugation, and (c) said liquid flows by gravity to the mouth of said container until said mouth of said container is completely covered with said liquid so as to prevent said animal from drawing air through said teat while allowing said head of said animal to remain in said comfortable, inclined position through feeding.

11. The method of claim 10 wherein said teat has a plurality of corrugations.

12. The method of claim 10 wherein said one end of said teat has a flange so as to permit said teat to be clamped to a rim of said container.

13. The method of claim 10 wherein said other end of said teat comprises a relatively rigid portion having a drinking orifice thereat, said at least one corrugation being spaced sufficiently from said rigid portion to permit said bending to occur substantially at a rim of said beverage container.

14. The method of claim 10 wherein said teat is formed from a flexible material comprising rubber elastomer.

15. The method of claim 10 wherein said teat has at least one obliquely and downwardly directed portion extending from said other end.

16. The method of claim 10 wherein said teat has a thicker wall portion surrounding said at least one corrugation to permit said bending to occur substantially at said at least one corrugation.

* * * * *